United States Patent [19]

Smits

[11] 4,369,859

[45] Jan. 25, 1983

[54] SCAFFOLDING SYSTEM

[75] Inventor: Marinus A. L. Smits, Henley-on-Klip, South Africa

[73] Assignee: SGB Group Limited, Surrey, England

[21] Appl. No.: 225,385

[22] Filed: Jan. 15, 1981

[30] Foreign Application Priority Data

Jan. 15, 1980 [ZA] South Africa ..... 80/0225

[51] Int. Cl.[3] ..... E04G 7/30

[52] U.S. Cl. ..... 182/179; 403/49

[58] Field of Search ..... 403/49; 182/179, 178; 52/637, 638

[56] References Cited

U.S. PATENT DOCUMENTS

| | | | |
|---|---|---|---|
| 2,308,832 | 1/1943 | Roney | 403/49 |
| 2,845,307 | 7/1958 | Holmes | 403/49 |
| 3,992,118 | 11/1976 | Siegers | 182/179 |
| 4,039,264 | 8/1977 | Sharp | 403/49 |
| 4,273,463 | 6/1981 | Dobersch | 403/49 |

FOREIGN PATENT DOCUMENTS

| | | | |
|---|---|---|---|
| 2842831 | 12/1979 | Fed. Rep. of Germany | 403/49 |
| 47908 | 8/1979 | Netherlands | 403/49 |
| 901351 | 7/1962 | United Kingdom | 403/49 |

*Primary Examiner*—Reinaldo P. Machado

*Attorney, Agent, or Firm*—Buell, Blenko, Ziesenheim & Beck

[57] ABSTRACT

In a scaffolding system an upright tube is provided with an annular dish shaped protrusion. A housing on the end of a horizontal tube carries a lever with a cam face that engages the protrusion to lock the tubes together. The horizontal tube can be at any radial orientation relative to the upright tube.

10 Claims, 4 Drawing Figures

SCAFFOLDING SYSTEM

BACKGROUND OF THE INVENTION

The present invention relates to scaffolding. More particularly the present invention relates to a scaffolding system including a joint between two substantially perpendicular scaffold members, one of said members having a protruding formation thereon, the other having a pivotally mounted lever with a cam face that can be brought into contact with part of said protruding formation to lock the said two members together.

Scaffolding of this type is disclosed in published European Patent Application No. 0003865. The disclosed scaffolding includes a vertical member which is provided with four protruding lugs thereon, the lugs being radially equi-spaced about the periphery of the vertical member. Each lug defines a vertical central rectangular aperture therethrough. Horizontal members which are to be connected to this vertical member are each provided with a hook-shaped assembly at the free end thereof, a part of each hook shaped assembly being adapted to be inserted through a respective lug. This portion that is adapted to be inserted through the luf carries the said pivotally mounted lever, and the lever can be moved to engage the undersurface of the lug to lock the horizontal member into position.

This prior proposed scaffolding system suffers from disadvantages. One particular disadvantage is that the horizontal members can only be connected to the vertical member whilst extending in one of four predetermined directions. A further disadvantage of the prior system is that, since the pivotal lever is carried by a part of a hook shaped assembly that must pass through a lug, the lever must be relatively small, or alternatively, the lug must be relatively large.

OBJECT OF THE INVENTION

The present invention seeks to provide a scaffolding system including a joint which reduces or obviates the disadvantages of the above described prior proposed system.

One object of the invention is to provide a scaffolding system which is such that each horizontal member can have any predetermined radial orientation relative to the vertical member to which it is conected.

It is a further object of the invention to provide a scaffolding system in which the parts of each connector move to the locking position when the connector is assembled.

One advantage of a preferred embodiment of the present invention is that a locking lever provided on a horizontal member is biased to the locking position and, when the horizontal member has been connected to the upright member, of the horizontal member is moved the locking effect provided by the lever is reinforced.

SUMMARY OF THE INVENTION

The present invention acomplishes the foregoing and other objects by providing a scaffolding system including a joint between two substantially perpendicuilar scaffold members, one of said members having a protruding formation thereon, the other having a pivotally mounted lever with a cam face that can be brought into contact with part of said protruding formation to lock the said two members together, wherein said protruding formation comprises an annular formation, which is substantially uniform around the periphery of said one member, said lever being carried by a housing mounted on one end of the second member adapted to cooperate with said protruding formation so that said second member may have any desired radial orientation relative to the first said member.

Preferably the first member on which the protruding formation is formed is upright and said protruding formation may comprise an annular member in the form of a dish or cup having an upwardly directed peripheral lip.

Preferably said second member is provided with a housing at the free end thereof, said housing having a downwardly extending portion defined by a recess formed in the housing adapted to be engaged with said protruding formation. Said second member may be provided with means which at least partially embrace said first member to prevent twisting or rotation of the second member about an axis transverse to the first member. The second member may be engaged with and disengaged from the protrusion on the first member by moving the said one end of the second member in direction substantially parallel with the axis of the first member.

Preferably said lever is biassed into a locking position, either by means of gravity or by means of a spring.

Advantageously when the housing is mounted on said protrusion the lever is initially moved away from the locking position against the said bias by means of engagement of the upwardly extending lip of the protrusion with part of the lever, the lever subsequently moving to the locking position with the cam on the locking lever engaging the undersurface of the protrusion.

Preferably when the lever is in the locking position, movement of the second scaffold member relative to the first scaffold member in a direction tending to disengage the first and second members causes the lever to lock the first and second members together firmly.

Other objects, features and advantages of the invention will become apparent from the following description of illustrative preferred embodiments.

BREIF DESCRIPTION OF THE DRAWINGS

DETAILED DESCRIPTION OF THE PREFERRED EMBODIMENTS.

Figure 1:
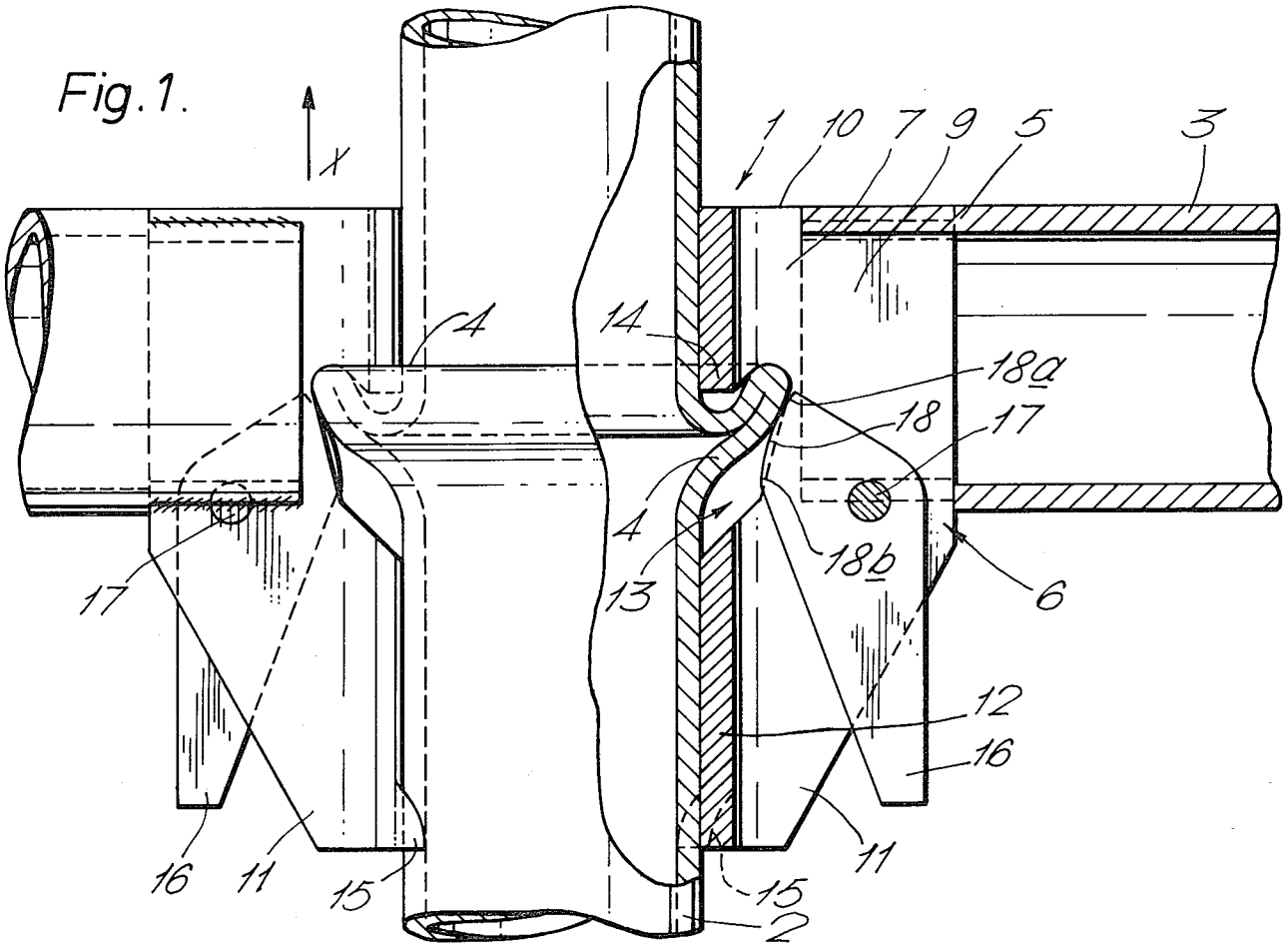
FIG. 1 is a part sectional elevational view of a first embodiment of part of a scaffolding system in accordance with the invention.
Figure 2:
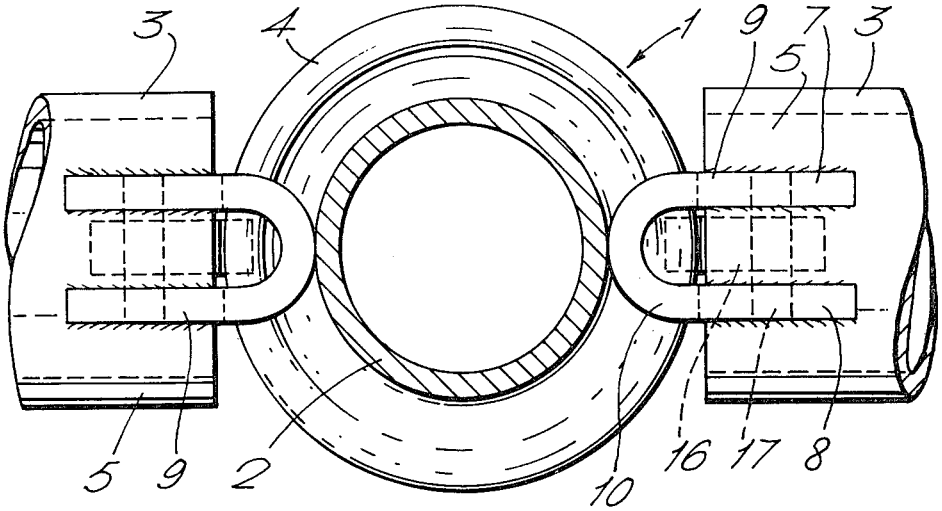
FIG. 2 is a top plan view of the part of the assembly shown in FIG. 1.
Figure 3:
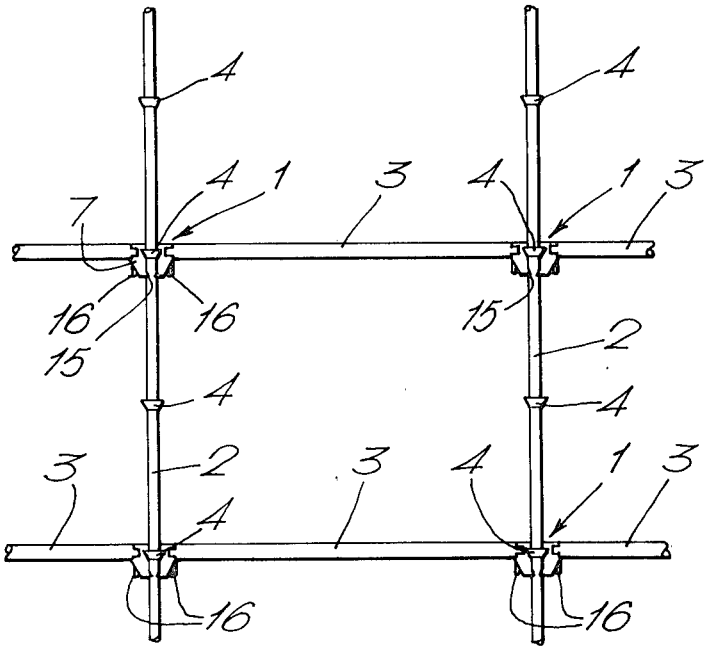
FIG. 3 is an elevational view of a larger part of the scaffolding assembly.

Referring initial to FIGS. 1 to 3 of the accompanying drawings the part of the scaffold in accordance with the invention which is illustrated constitutes a rigid connection 1 between a vertical tube or standard 2 and a horizontal tube or ledger 3. The standard and ledger may be formed of any appropriate tubing such as steel tubing or aluminium tubing.

As can be seen from FIG. 1 a dish or cup shaped protrusion 4 is formed, by a suitable compression and forming operation, integrally with the vertical tube 2.

The protrusion 4 protruding radially and upwardly from the vertical tube 2. The protrusion is uniform around the entire periphery of the vertical tube 2. There are preferably a plurality of spaced protrusions 4 along the length of any particular vertical tube 2.

Connected to one end 5 of the horizontal tube 3 is a clamping assembly 6 which is utilised to clamp the horizontal member 3 to the protrusion 4. The clamping assembly 6 comprises a housing 7 which is, when viewed in plan, of substantially "U" configuration, as can be seen from FIG. 2. The two arms 8, 9 of the "U" configured housing are located in two parallel vertical slots cut into the end of the horizontal tube 3 and the housing 7 is welded in position. As can be seen from FIG. 1 the upper surface 10 of the housing 7 is substantially flush with the upper surface of the horizontal tube 3, but a portion 11 of the housing 7 projects below the lower surface of the horizontal tube 3. The forwardly projecting part 12 of the housing 7 comprises the base of the "U" and is intended to abut against the side of the vertical tube 2. A recess 13 is cut in this forwardly projecting part 12 of the housing so that a downwardly extending portion 14 is defined which can engage over the lip defined by the protrusion 4. Thus the housing 7 can be hooked over the protrusion 4 with the forwardly projecting part 12 of the housing 7 engaging the surface of the vertical tube 2. On the downwardly projecting portion 12 of the housing there are two projections 15, one on either side of the vertical axis of the housing, the projections 15 partially embracing the vertical tube 2 to prevent the horizontal tube 3 from twisting or rotating about its axis.

A clamping lever 16 is pivotally mounted about a pivot shaft 17, the pivot shaft 17 extending between the two arms 8, 9 of the housing 7. A portion of the clamping lever protrudes beyond the housing 7 so that the clamping lever can easily be grasped manually to rotate the clamping lever. The clamping lever 16 has a curved cam surface 18. The cam surface 18 is of such a configuration that the distance from an upper part **18*a* of the cam surface, as illustrated in FIG. 1, to the pivot 17 is greater than the distance between a lower part 18*b* of the cam surface as illustrated in FIG. 1 and the pivot 17. The cam surface 18 is so located that, when the housing 7 has been hooked over the protrusion 4, with the lever 16 in an initial position in which the protruding end of the lever is in close proximity with the vertical tube 2, the lower portion of the cam surface lies immediately adjacent the under surface of the protursion. The protruding end of the lever 16 may then be moved away from the tube 2, and the cam surface 18 will be brought into very film wedging engagement with the undersurface of the protrusion 4. Thus the horizontal tube 3, is rigidly secured to the protrusion 4**. Appropriate tools may be used to rotate the lever if necessary.

It is preferred that the lever 16 shall be biassed towards the locking position, and this can be achieved by providing the lever with an appropriate mass distribution relative to the pivot axis so that the lever will tend to rotate towards the locking position under the influence of gravity.

As can be seen from FIG. 3 scaffolding utilising connections as described above can be assembled to comprise a regular array of vertical tubes 2 and horizontal tubes 3. Also, as can be seen from FIG. 3, protrusions 4 are provided at evenly spaced intervals on the vertical tubes 2.

Figure 4:
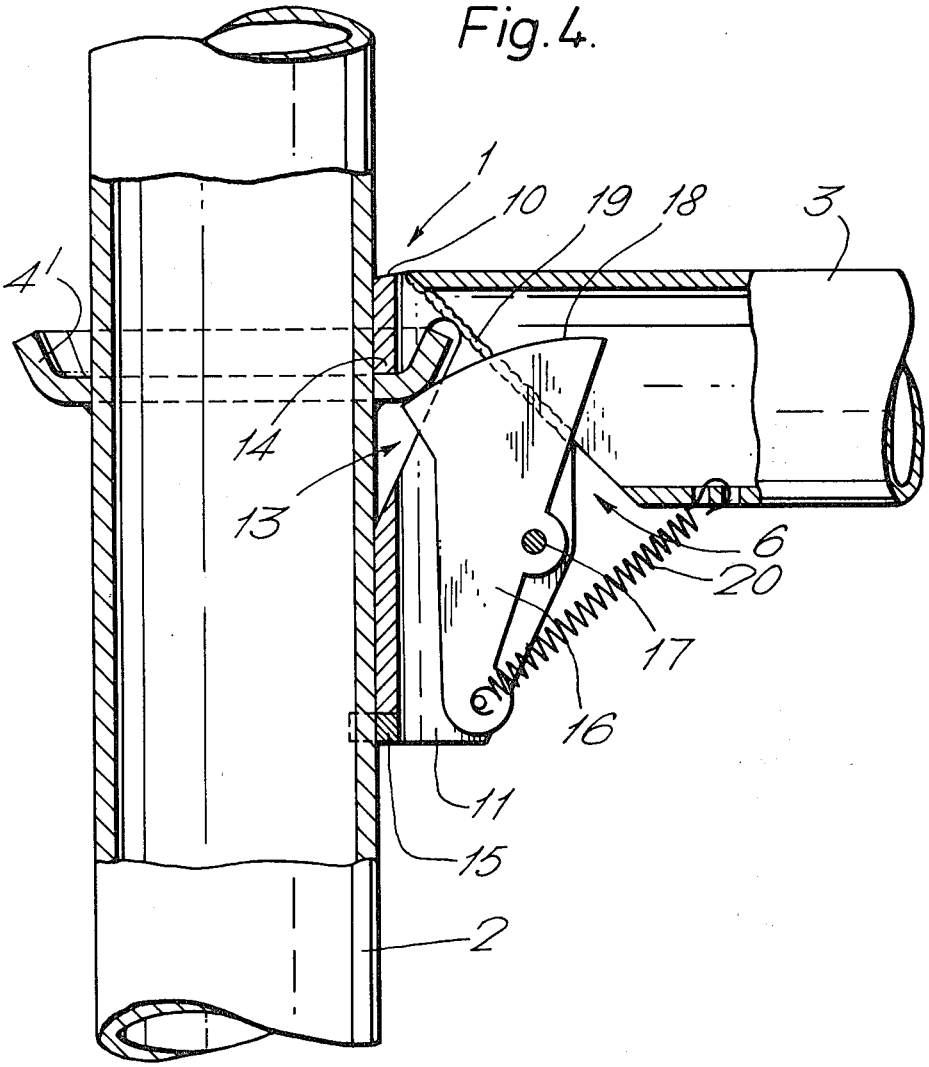
FIG. 4 is a part sectional elevation of part of a second embodiment of a scaffolding assembly in accordance with the invention.

Referring now to FIG. 4 it will be appreciated that the embodiment illustrated in FIG. 4 is generally similar to the embodiment illustrated in FIGS. 1 to 3. Like reference numerals apply to like parts.

It is to be noted that in this embodiment the vertical tube is provided with a protrusion 4' in the form of a dish shaped annular element which is a separate element welded onto the vertical tube 2. It will also be noted that the housing of the clamping assembly 7 is welded directly to the end of the horizontal tube 3 by means of a weld 19, the weld lying on a line at 45 degrees to the horizontal. However it will be appreciated that the housing projects beyond the end of the horizontal tube 2, the upper surface 10 of the housing being flush with the upper surface of the tube, with a lower portion 11 of the housing projecting beneath the tube. Again a recess 13 is formed in the housing so that a downwardly extending portion 14 of the housing is defined that can be hooked over the protrusion 4'.

A tension spring 20 is shown in FIG. 4 which serves to bias the lever 16 towards the locking position, the tension spring being connected to the lower end of the lever 16 and to the horizontal tube 3.

It will be appreciated that scaffolding incorporating joints as described above may be easily and rapidily assembled. The upright tubes are temporarily held in position with the protrusions 4 or 4' directed upwardly, and the housings 7 of the clamping assemblies 6 are then manipulated so that the downwardly extending portions 14 are hooked over the lips of the protrusions 4. During this action the uppermost lip of the securing formation will engage the pivoted lever 16, which is biassed towards the locking position by gravity or by the spring, and will move the lever 16 against this bias to enable the downwardly extending portion 14 of the housing to be located over the lip of the cup shaped projection. The lever 16 will then return to the locking position under its natural bias. This minimises the risk of any joint becoming loose, even if the levers are not manually forced into the locking position when the scaffolding is assembled.

Whenever there is a movement tending to disengage the housing 7 from the protrusion 4 or 4' the locking effect of the lever 16 is, of course, reinforced.

The described scaffolding joints may readily be disengaged by simply manually moving the locking lever 16 to a release position and lifting the housing 7 so that the downwardly extending portion 14 of the housing is disengaged from the protrusion 4 or 4'.

It will be appreciated that scaffolding as described above has the advantage that the horizontal tubes can be located at any specific radial orientation relative to the vertical tube 1, since the protrusion 4 is an annular member which is uniform around the entire periphery of the vertical tube and thus does not pre-dictate any specific radial orientation for the horizontal tube 3. Also it is to be appreciated that the locking lever 16 can be made to be of any convenient size, since the lever 16 does not have to pass through any apertures. It is envisaged that in certain embodiments of the invention, a pivotal mounting may be provided between the housing 7 and the tube 3, and thus the tube 3 may be moved to be inclined at any predetermined angle. Of course, embodiments of the invention may be prepared in which the housing is at a predetermined angle to the tube to which it is connected, so that the tube 3 will then extend at a predetermined angle relative to the vertical tube.

It is to be noted that in utilising joints as described above a plurality of transverse members may be independentaly attached to or separated from a vertical tube at any given point. This enables complex scaffolding configurations to be achieved easily.

To those skilled in the art to which this invention relates many changes in construction and widely different embodiments and applications of the invention will suggest themselves without departing from the spirit of scope of the invention. The disclosures and the description herein are purely illustrative and are not intended to be in any sense limiting.

What is claimed is:

1. A scaffolding system, said system including a first scaffold member, and a second scaffold member substantially perpendicular thereto, said second member being connected to the first member by means of a joint; said joint comprising an annular protruding formation on said first member, said protruding formation being substantially uniform around the periphery of said first member, a housing mounted on one end of the second member, a lever pivotally mounted on the housing, the lever defining a cam face, means on the housing to engage the said annular protruding formation with the said second member in any selected radial orientation to the first member and with the lever in a position such that the said cam face can be brought into locking engagement with the annular protruding formation to lock the members together.

2. A scaffolding system according to claim 1, wherein the first member on which said protruding formation is formed, is upright and said protruding formation comprises an annular member in the form of a dish or cup having an upwardly directed peripheral lip.

3. A scaffolding system according to claim 2, wherein the said second member is provided with a housing at the free end thereof, said housing having a downwardly extending portion defined by a recess formed in the housing adapted to be engaged with said protruding formation.

4. A scaffolding system according to claim 3, wherein said second member is provided with means which at least partially embrace said first member to prevent twisting or rotation of the second member about an axis transverse to the first member.

5. A scaffolding system according to claim 1, wherein the second member may be engaged with an disengaged from the protrusion on the first member by moving the said one end of the second member in direction substantially parallel with the axis of the first member.

6. A scaffolding system according to claim 1, wherein the lever is biassed to a locking position.

7. A scaffolding system according to claim 6, wherein the lever is biassed to a locking position by means of gravity, the mass distribution of the lever relative to the axis of pivoting of the lever being such that, under the influence of gravity, the lever pivots to the locking position.

8. A scaffolding system according to claim 6, wherein the lever is biassed to a locking position by means of a spring.

9. A scaffolding system according to claim 1, wherein when the housing is mounted on said protrusion the lever is initially moved away from the locking position against the said bias by means of engagement of the upwardly extending lip of the protrusion with part of the lever, the lever subsequently moving to the locking position with the cam on the locking lever engaging the undersurface of the protrusion.

10. A scaffolding system according to claim 1, wherein when the lever is in the locking position, movement of the second scaffold member relative to the first scaffold member in a direction tending to disengage the first and second members causes the lever to lock the first and second members together firmly.

* * * * *

UNITED STATES PATENT AND TRADEMARK OFFICE

CERTIFICATE OF CORRECTION

PATENT NO. : 4,369,859

DATED : January 25, 1983

INVENTOR(S) : MARINUS A. L. SMITS

It is certified that error appears in the above-identified patent and that said Letters Patent are hereby corrected as shown below:

Column 1, line 24, "luf" should be --lug--.

Column 2, line 43, "BREIF" should be --BRIEF--.

Column 2, line 59, "initial" should be --initially--.

Column 3, line 50, "protursion" should be --protrusion--.

Column 3, line 53, "film" should be --firm--.

Column 5, line 3, "dependentaly" should be --dependently--.

Claim 5, column 6, line 9, "an" should be --and--.

Signed and Sealed this

*Nineteenth* Day of *April 1983*

[SEAL]

*Attest:*

GERALD J. MOSSINGHOFF

*Attesting Officer*

*Commissioner of Patents and Trademarks*